US006435844B1

(12) United States Patent
Fukami

(10) Patent No.: US 6,435,844 B1
(45) Date of Patent: Aug. 20, 2002

(54) DIAPHRAGM PUMP

(75) Inventor: Tadashi Fukami, Inagi (JP)

(73) Assignee: Oken Seiko Co., LTD, Inagi (JP)

( * ) Notice: Subject to any disclaimer, the term of this patent is extended or adjusted under 35 U.S.C. 154(b) by 135 days.

(21) Appl. No.: 09/668,738

(22) Filed: Sep. 25, 2000

(30) Foreign Application Priority Data

Sep. 24, 1999 (JP) ..... 11-269869

(51) Int. Cl.[7] ..... F04B 43/06; F04B 45/00
(52) U.S. Cl. ..... 417/395
(58) Field of Search ..... 417/395, 412, 417/413.1, 383, 384, 540, 543

(56) References Cited

U.S. PATENT DOCUMENTS 4,737,083 A * 4/1988 Meyer ..... 417/413
6,071,090 A * 6/2000 Miki et al. ..... 417/395

FOREIGN PATENT DOCUMENTS

JP 10281070 A 10/1998

* cited by examiner

*Primary Examiner*—Charles G. Freay
*Assistant Examiner*—William Rodriguez
(74) *Attorney, Agent, or Firm*—Pillsbury Winthrop, LLP

(57) ABSTRACT

A diaphragm pump comprising a first diaphragm operated with a driving mechanism such as a crank mechanism, a second diaphragm disposed so as to form an air chamber between the first diaphragm and the second diaphragm, and a pump chamber formed by the second diaphragm and a casing or the like, wherein the a pressure in the air chamber is changed by operating the first diaphragm with the driving mechanism and the second diaphragm is deformed by a change of the pressure in the air chamber to perform a pump function.

7 Claims, 8 Drawing Sheets

DIAPHRAGM PUMP

BACKGROUND OF THE INVENTION a) Field of the Invention:

The present invention relates to a pump which is used in a hot water supply apparatus or the like for feeding hot water.

b) Description of the Prior Art

An impeller pump is conventionally used as a pump in a hot water supply apparatus such as a jar, a pot or the like for feeding a liquid at a relatively high temperature.

This impeller pump has such a configuration as that shown in FIG. 1, and when the pump is to be used for feeding hot water, a hole 30*a* is formed in a bottom of a vessel 30 of a hot water supply apparatus to be filled with hot water and a suction port of the pump is connected to the hole. In FIG. 1 which illustrates the configuration of the impeller pump, a reference numeral 31 represents a casing of the pump, a reference numeral 32 designates a partition panel which airtightly partitions a pump chamber 33 from a driving section 34, a reference numeral 35 denotes a shaft which is supported by a supporting member 36, a reference numeral 37 represents a holding member for holding an impeller and a magnet which are disposed rotatably around the shaft 35, a reference numeral 38 designates an impeller which rotates together with the holding member 37, and a reference numeral 39 denotes a follower magnet which rotates together with the holding member 37: all of these members being disposed in the pump chamber 33. In the driving section 34 partitioned with the partition panel 32, a driving magnet 40 which is rotated with a motor 41 is disposed so as to oppose to the follower magnet 39 with the partition panel 32 interposed.

This impeller motor rotates the driving magnet 40 by driving the motor 41 and rotates a follower magnet 39 which is magnetically coupled with the driving magnet 40 by rotating the driving magnet 40. When the follower magnet 39 is rotated, the impeller 38 is rotated to perform a pump function.

By the pump function of the impeller 38, hot water is sucked out of the vessel 30, sucked through a suction port 42 of the impeller pump and discharged from a discharge port 43.

Furthermore, a diaphragm pump is known as a pump which supplies a liquid or the like.

The diaphragm pump has a configuration shown in FIG. 2, wherein a reference numeral 50 represents a motor, a reference numeral 51 designates a crank body which is fixed to an output shaft 50*a* of the motor 50, a reference numeral 52 designates a driving shaft which is pressed and fixed into the crank body 51 at a location eccentric from the output shaft 50*a*, a reference numeral 53 denotes a connecting rod which is rotatably coupled with the driving shaft 52 and a reference numeral 54 represents a diaphragm made of a synthetic rubber or the like which is fixed to a tip of the connecting rod. Formed as an outer circumferential portion of the diaphragm 54 is a sealing portion which is sandwiched between a clamp plate 55 and a casing 66 to seal a pump chamber from external air. Furthermore, a reference numeral 61 represents a suction port, a reference numeral 62 designates a discharge port, and check valves 58 and 59 such as leaf valves are disposed in the suction port 61 and the discharge port 62 respectively.

When the motor 50 is driven and its output shaft 50*a* is rotated, the diaphragm pump which has the configuration described above rotates the crank body 51, the driving shaft 52 moves the diaphragm 54 upward and downward by way of the connection rod 53 and, upward and downward movements of the diaphragm 54 increase and decrease a volume of the pump chamber 60. When the volume of the pump chamber 60 is increased, the leaf valve 58 opens and a fluid is sucked through the suction port 61 and when the volume of the pump chamber 50 is decreased, the leaf valve 59 opens and the fluid is discharged from the discharge port 62, thereby performing a pump function.

When hot water is sucked from a vessel and supplied using an impeller pump such as that shown in FIG. 1, air bubbles are produced in the pump. Since a vapor pressure is lower in the vicinity of a rotating center of the impeller 38, that is, in the vicinity of the shaft 35 in particular than those in other locations in the pump chamber 33, the produced air bubbles are collected in the vicinity of the shaft 35, close the suction port 42 and make the hot water hardly flow, thereby remarkably lowering a hot water supply capability of the pump or disabling the pump from supplying the hot water in a worse case.

Furthermore, the impeller pump which is used for supplying hot water has a defect that the pump requires a high cost since it uses a large number of expensive parts such as two magnets of the driving magnet 40 and the follower magnet 39 as shown in FIG. 1 to maintain sufficient airtightness.

Furthermore, a diaphragm pump such as that shown in FIG. 2 is not disabled from supplying hot water since the pump is capable of exhausting bubbles at a certain degree even when bubbles are produced. However, the diaphragm pump has a defect that it cannot assure a sufficient reliability from a viewpoint of a service life of the diaphragm which is made of the synthetic rubber since a certain kind of synthetic rubber adds an abnormal taste or an abnormal odor to hot water and is hardened dependently on a vapor temperature or the like.

Furthermore, some of diaphragm pumps use metal diaphragms. FIG. 3 shows an example of diaphragm pump using a metal diaphragm 70 as a diaphragm and has a configuration substantially the same as that of the diaphragm pump using the diaphragm made of the synthetic rubber shown in FIG. 2, except for the metal diaphragm 70 which is sandwiched and fixed between a connecting rod 53 and a retainer 71. Accordingly, a pump function of the diaphragm pump shown in FIG. 3 which is similar to that of the diaphragm pump shown in FIG. 2 and is performed by deforming the metal diaphragm so as to change a volume of a pump chamber.

The diaphragm pump which uses the metal diaphragm has a defect that stresses are concentrated on a middle portion of the metal diaphragm (an outer circumference of the connecting rod 53) when the metal diaphragm is displaced largely, whereby this portion is liable to be broken and the diaphragm has an extremely short service life. In order to correct this defect, the diaphragm pump is configured large or when the pump is configured to cause a relatively short displacement of the metal diaphragm, the diaphragm pump has another defect that it cannot exhaust air bubbles sufficiently and lowers a flow rate.

Furthermore, a diaphragm pump disclosed by Japanese Patent Kokai Application No Hei 10-281070 is known as another conventional diaphragm pump.

This pump has a configuration shown in FIG. 4, wherein the pump comprises a pump chamber 74 formed by an upper half 71 of a pump body 70 and a diaphragm 73, a piston 75 attached to a lower half 72 of the pump body 70, and an operating fluid 76 sealed between the piston 75 and the diaphragm 73.

The conventional pump shown in FIG. 4 performs a pumping action by producing a pressure of the operating fluid with an action of the piston 75, deforming the diaphragm 73 with the pressure, and increasing and decreasing a volume of the pump chamber.

Judging from embodiments, this diaphragm pump basically uses a liquid as the operating fluid though description is made that air (a gas) can be used as the operating fluid and the diaphragm pump basically uses a sheet of expansible and contractible synthetic resin such as teflon or synthetic rubber as the diaphragm 73 though description is made that a thin metal plate is used as the diaphragm 73.

When a piston is used for deforming the diaphragm 73 as in this conventional example, it is important to prevent a fluid from leaking and when a liquid is used as an operating fluid in particular, prevention of liquid leakage constitutes an important theme. Accordingly, sealing of a piston section poses a difficult problem and a diaphragm pump has a defect that it is made expensive for complete sealing.

SUMMARY OF THE INVENTION

An object of the present invention is to provide a diaphragm pump which comprises a first diaphragm which is operated with a driving mechanism such as a crank mechanism, a second diaphragm disposed so as to form an air chamber between the first diaphragm and the second diaphragm, a pump chamber formed on a side opposite to the air chamber, an inflow port connected to the pump chamber by way of a check valve and an outflow port connected to the same pump chamber by way of a check valve, and is configured to perform a pump function by changing a pressure in the air chamber between the first diaphragm and the second diaphragm with a function of the crank mechanism, deforming the second diaphragm by the change of the pressure and changing a volume of the pump chamber by the deformation of the second diaphragm.

The diaphragm pump according to the present invention distributes stresses uniformly and is not problematic in its durability since the second diaphragm is deformed not directly by the driving mechanism such as the crank mechanism but by utilizing the pressure change in the air chamber even when a metal diaphragm which is resistant to high temperature hot water is used in the pump chamber, that is, even when metal diaphragm is used as the second diaphragm.

DETAILED DESCRIPTION OF THE PREFERRED EMBODIMENTS

Now, description will be made of the preferred embodiments of the present invention.

Figure 5:
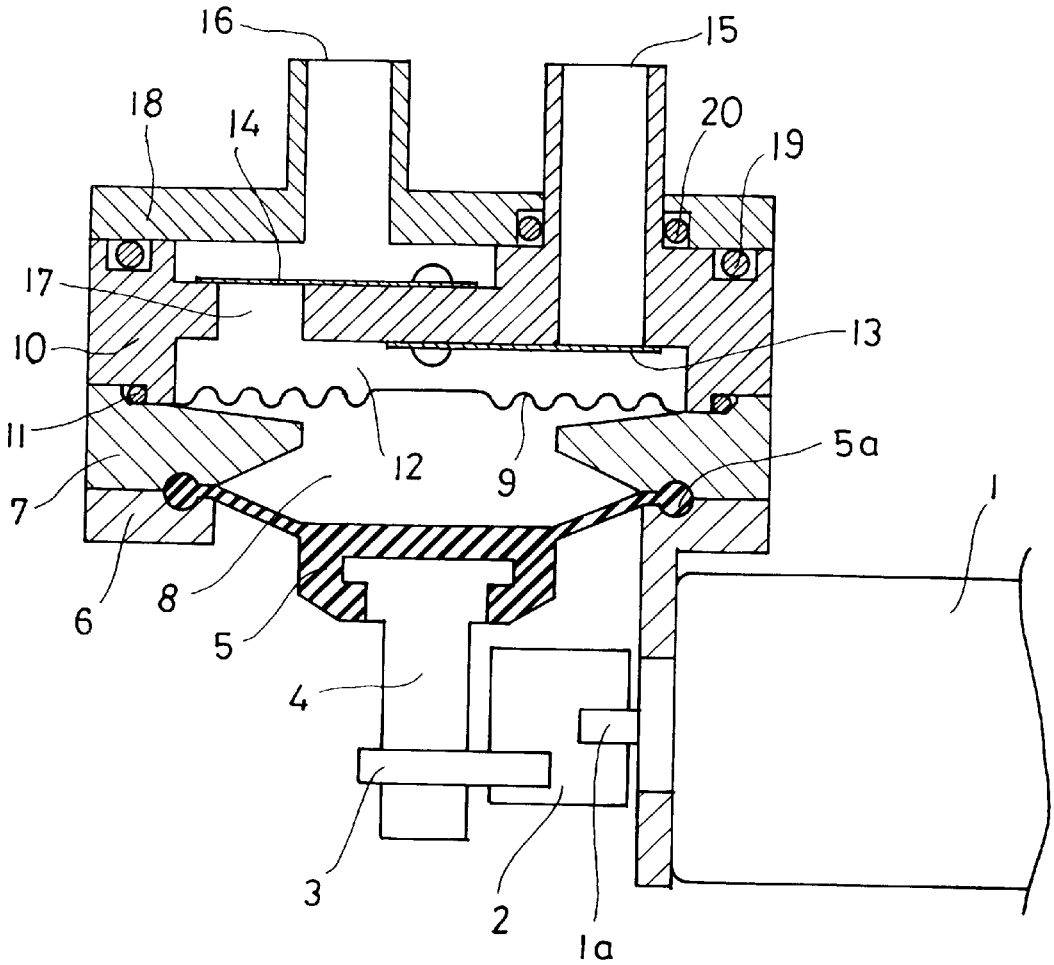
FIG. 5 is a diagram showing a configuration of a first embodiment of the diaphragm pump according to the present invention.
Figure 6:
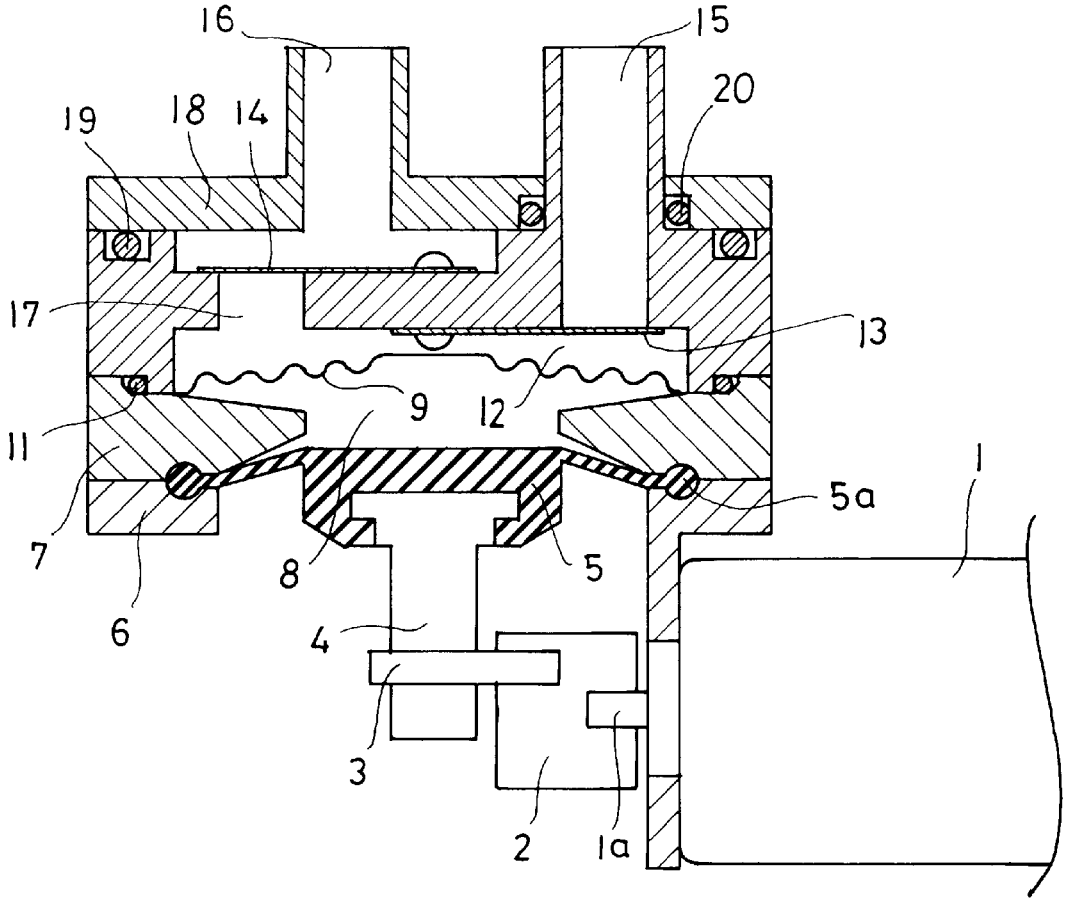
FIG. 6 is a diagram showing another condition of the pump shown in FIG. 5.

FIGS. 5 and 6 are diagrams showing a configuration of a diaphragm pump preferred as a first embodiment of the present invention, wherein a reference numeral 1 represents a motor, a reference numeral 2 designates a crank body which is fixed to an output shaft la of the motor 1, a reference numeral 3 denotes a driving shaft which is fixed to the crank body 2 eccentrically from a rotating axis (the output shaft la) of the crank body, a reference numeral 4 represents a connecting rod attached to the driving shaft 3, a reference numeral 5 designates a first diaphragm made of synthetic rubber or another material to which is a tip of the connecting rod 4 is attached, and reference numerals 6 and 7 denote a clamp plate and a spacer respectively which sandwich a sealing member 5*a* disposed on a circumference of the first diaphragm 5. A reference numeral 9 represents a second diaphragm which is manufactured by drawing a metal plate such as a thin stainless steel plate into a corrugated form and sandwiched between the spacer 7 and a casing 10. An air chamber 8 is formed between the first and second diaphragms 5 and 9, and a pump chamber 12 is formed between the second diaphragm 9 and the casing 10. Furthermore, reference numerals 13 and 14 designate check valves (leaf valves), a reference numeral 15 denotes an inflow port, a reference numeral 16 represents an outflow port, a reference numeral 17 represents an outflow hole 17 and a reference numeral 18 designates a cover. Furthermore, reference numerals 19, 20 and the like designate O rings.

When the output shaft l*a* is rotated by driving the motor 1 in the diaphragm pump preferred as the first embodiment shown in FIGS. 5 and 6 in a condition shown in FIG. 5, the driving shaft 3 which is fixed to the crank body 2 is also rotated and pushes up the connecting rod 4. FIG. 6 shows a condition where the driving shaft la makes half a rotation.

When the connecting rod 4 is pushed up by the rotation of the driving shaft 1*a* as in the condition shown in FIG. 6, the first diaphragm 5 is pushed up, thereby reducing a volume of the sealed air chamber 8 and enhancing a pressure in the air chamber 8. The enhancement of the pressure in the air chamber 8 swells the second diaphragm 9 upward, thereby reducing a volume of the pump chamber 12. The reduction of the volume of the pump chamber 12 causes a fluid in the pump chamber to open the leaf valve 13 from the outflow hole 17 and is discharged from the outflow port 16.

When the output shaft 1*a* of the motor 1 is further rotated and the driving shaft 3 is rotated by way of the crank body 2 until it is set again in the condition shown in FIG. 5, the first diaphragm 5 is lowered, the pressure is lowered in the air chamber 8, the second diaphragm 9 is lowered and the volume of the pump chamber 12 is enlarged, whereby the fluid opens the leaf valve 13 from the inflow port 15 and enters the pump chamber 12.

A pump function is performed by repeating operations described above.

In the pump preferred as the first embodiment of the present invention, the first diaphragm 5 is made of synthetic rubber, synthetic resin or the like and is deformable. Therefore, deformation of the first diaphragm 5 functions to prevent the motor which drives this diaphragm from being locked even when a flow path is intercepted due to a trouble or an accident and hot water does not flow in the discharge port of the pump or a hot water supply flow path beyond the discharge port. Accordingly, the motor is free from a fear that the motor is overheated in a locked condition.

The diaphragm pump preferred as the first embodiment of the present invention rarely allows the metal diaphragm to be broken and has a long service life since the second diaphragm 9 which performs the pump function is deformed upward and downward without unreasonableness due to pressure changes in the air chamber. Since bubbles produced in the pump chamber 12 are pushed out together with the liquid, the diaphragm pump preferred as the first embodiment is not disabled from flowing out the liquid though the liquid is flowed out in an amount reduced by a volume of the bubbles.

Figure 7:
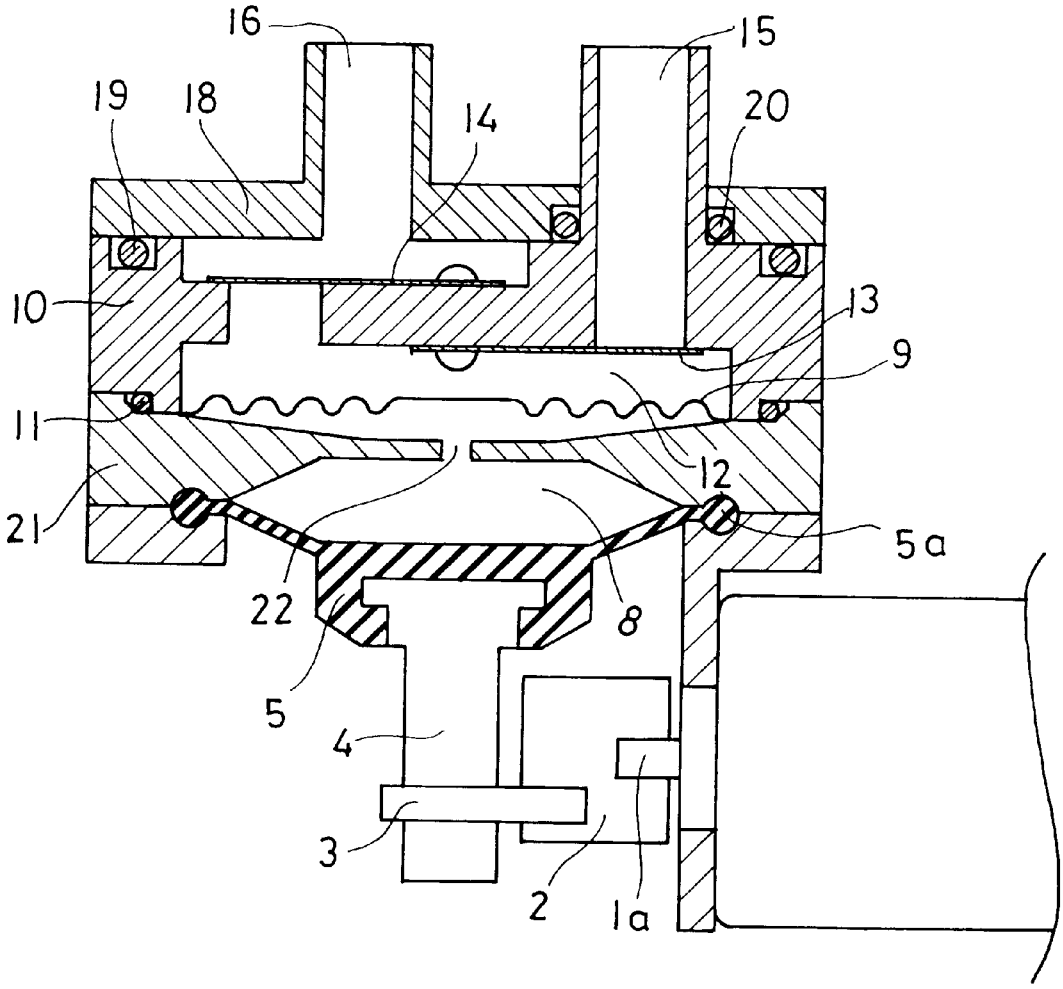
FIG. 7 is a diagram showing a configuration of a second embodiment of the diaphragm pump according to the present invention.

A second embodiment of the present invention has a configuration shown in FIG. 7, and is characterized in that a plate like member 21 which partitions into two an air chamber 8 between a first diaphragm 5 and a second diaphragm 9 is disposed in place of the spacer 7 in the pump shown in FIGS. 5 and 6, that an orifice 22 is formed in the plate like member 21 and that the orifice 22 composes breakage detecting means. The second embodiment is substantially the same as the first embodiment, except for the plate like member which has the orifice 22.

When the first diaphragm 5 is moved upward and downward due to a movement of the driving mechanism, air flows from the air chamber through the orifice 22 and changes a pressure in the air chamber 8, and the second diaphragm 9 moves like that in the pump preferred as the first embodiment, whereby the second embodiment performs a pump function.

The pump preferred as the first embodiment detects an abnormal condition only after the first diaphragm made of synthetic rubber or the like is broken since the pump continues the pump function by continuously moving the first diaphragm 5 upward and downward even when the second diaphragm 12 is broken and a fluid such as hot water leaks and enters the air chamber.

In contrast, the pump preferred as the second embodiment in which the air chamber is partitioned by the plate like member 21 serving also as a spacer and air flows through the orifice 22 to change the pressure is capable of detecting an abnormal condition before the first diaphragm is broken since the hot water flows through the orifice in a small amount per unit time due to viscosity of a liquid and a normal pump function is not performed even when the second diaphragm 9 is broken and hot water flows into the air chamber.

Accordingly, the second embodiment does not continue an operation without detecting the abnormal condition when the second diaphragm is broken and prevents water leakage from being caused by breakage of the first diaphragm.

Even when the second diaphragm is broken and the fluid (hot water) flows into the air chamber in the second embodiment, the first diaphragm 5 which is made of the synthetic rubber or synthetic resin is deformed (expanded) and the motor 1 which drives the first diaphragm 5 is not set in a locked condition.

Figure 1:
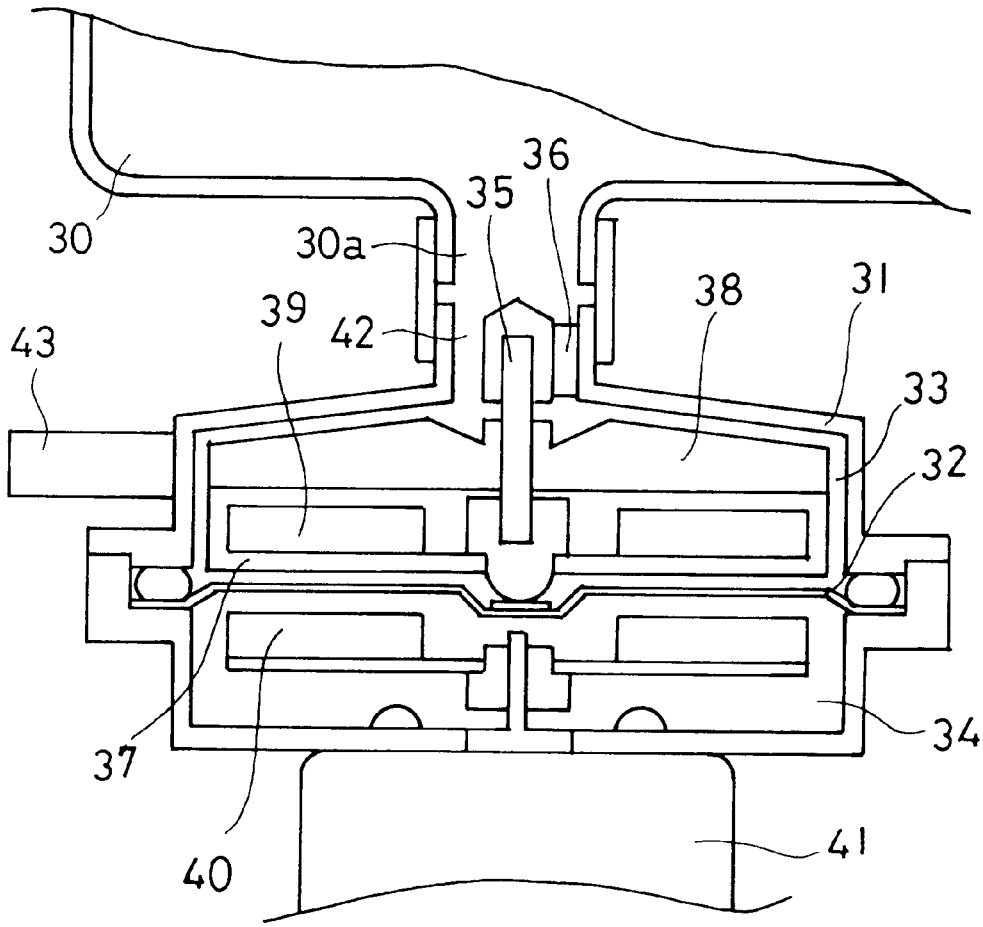
FIG. 1 PRIOR ART
FIG. 1 is a diagram showing a configuration of a conventional impeller pump.
Figure 2:
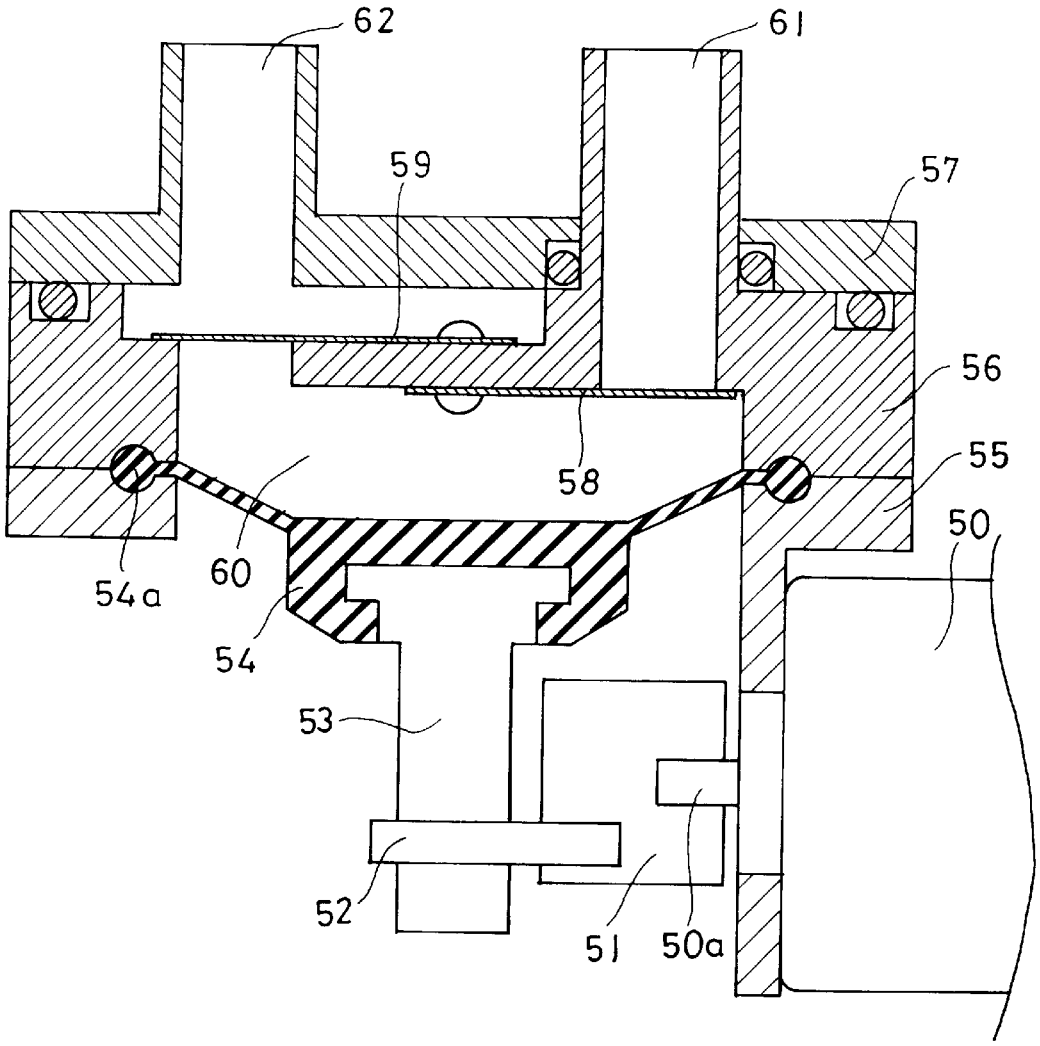
FIG. 2 PRIOR ART
FIG. 2 is a diagram showing a configuration of a conventional diaphragm pump.
Figure 3:
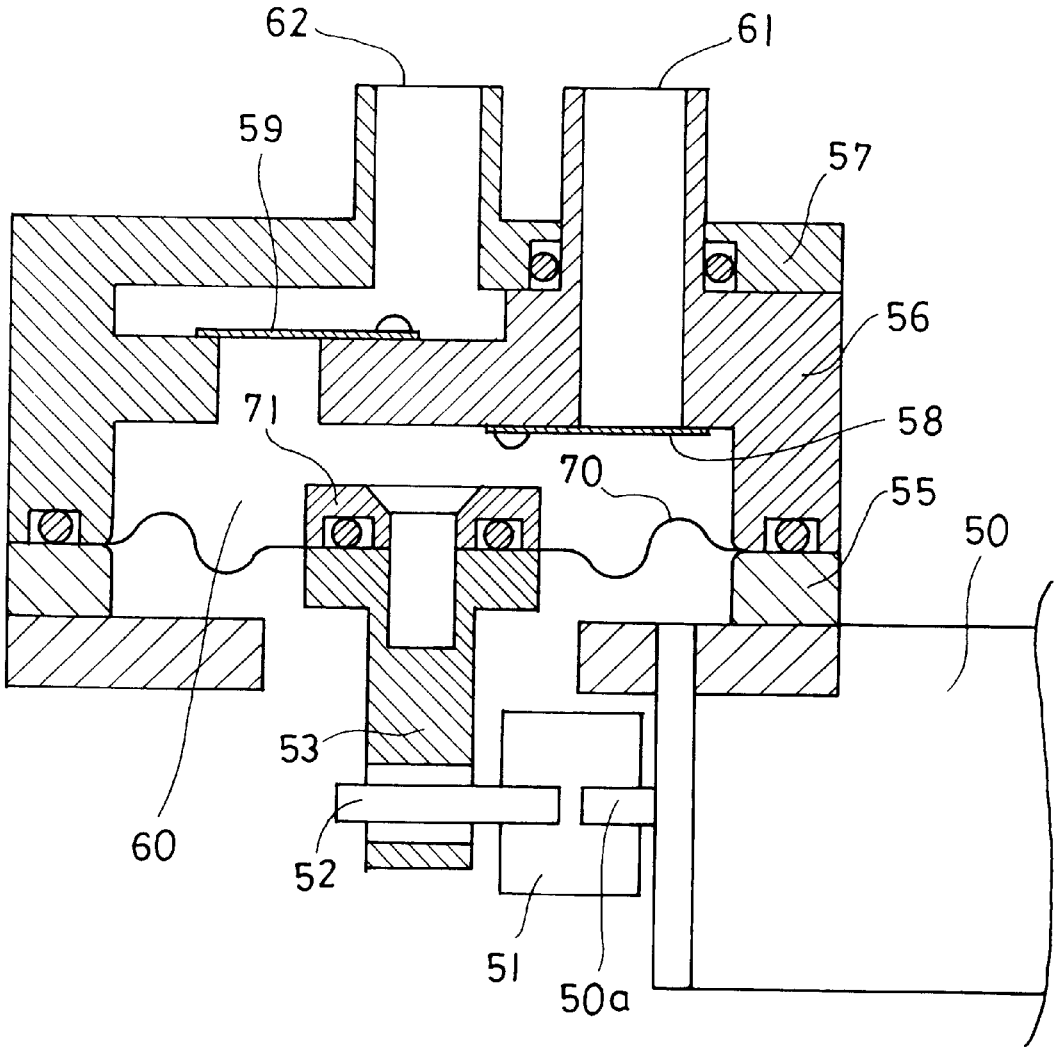
FIG. 3 PRIOR ART
FIG. 3 is a diagram showing a configuration of another conventional diaphragm pump.
Figure 4:
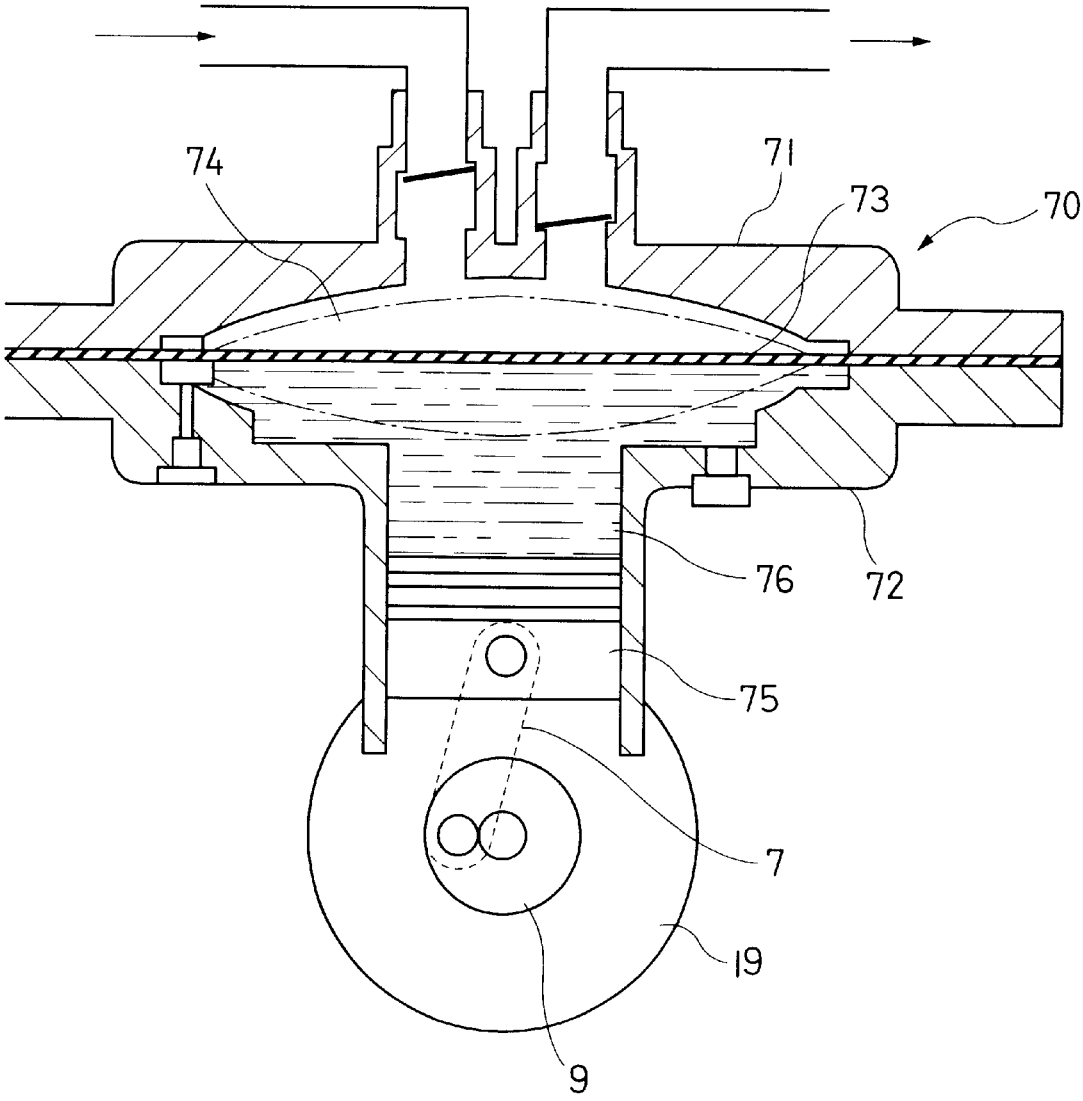
FIG. 4 PRIOR ART
FIG. 4 is a diagram showing a configuration of still another conventional diaphragm pump.

In a case where a piston is used in place of the first diaphragm 5 as in the conventional example shown in FIG. 4, in contrast, the fluid enters on a piston side of the plate like member 21 when the second diaphragm is broken and the fluid flows into the air chamber, thereby the piston cannot move and the motor which drives the piston is set in a locked condition. As a result, the breakage of the second diaphragm constitutes a highly hazardous condition where the motor or the like is overheated and emits smoke.

Figure 8:
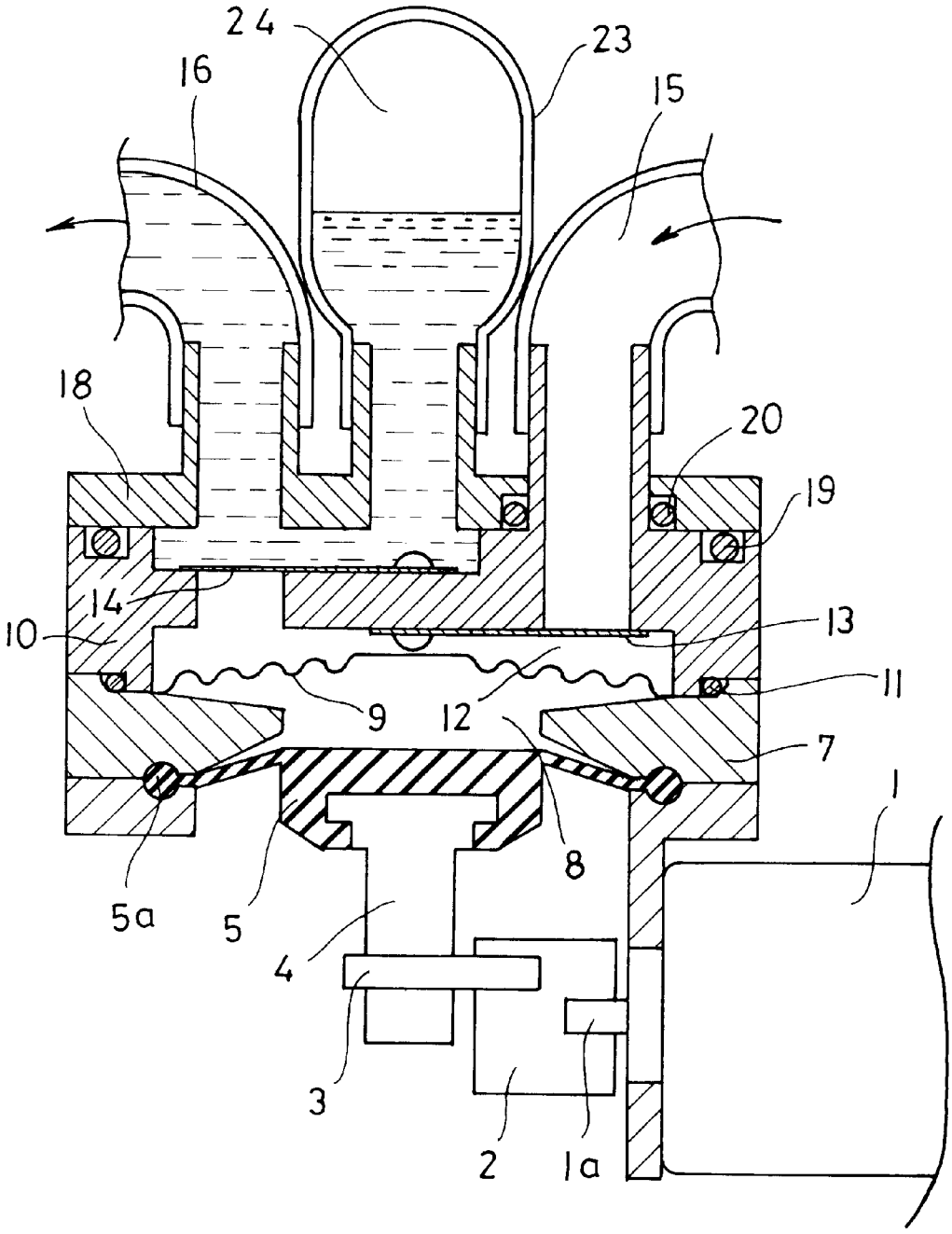
FIG. 8 is a diagram showing a configuration of a third embodiment of the diaphragm pump according to the present invention.

FIG. 8 is a diagram showing a third embodiment of the diaphragm pump according to the present invention.

A pump preferred as the third embodiment is characterized in that an accumulator 24 which is made of silicone rubber or the like is added to the cover 18 and substantially the same as the pump preferred as the first embodiment or the second embodiment except for the accumulator.

The pump preferred as the first or the second embodiment discharges a liquid each time the motor 1 makes half a rotation and discharges the liquid as a pulsating flow. That is, a liquid flow oscillates. Accordingly, the pump causes a liquid splashing phenomenon beyond the outflow port, for example, from an outflow port of a pot or the like.

In the third embodiment described above, the accumulator 24 which is made of silicone rubber or the like is attached to the cover 18 and connected to a flow path or the like communicated with the outflow port so that an amount of a discharged fluid is made nearly constant by increasing and decreasing a volume of air in the accumulator 24 even when a liquid which opens the leaf valve from the pump chamber and flows through the outflow port pulsates. Speaking concretely, the third embodiment is capable of reducing a pulsating flow by automatically reducing the volume of the air in the accumulator when the discharged fluid has a high pressure and enlarging the volume when the discharged fluid has a low pressure. Accordingly, a portion of the fluid flows into the accumulator and compresses air in the accumulator when a pressure is enhanced in the air chamber by a function of the first diaphragm 5, the second diaphragm is deformed by the enhancement of the pressure, a volume of the pump chamber is reduced by deformation of the second diaphragm and the fluid is discharged from the pump chamber toward an outflow side, accordingly, a portion of the fluid to be discharged is accumulated in the accumulator. Successively, the first diaphragm functions to lower the pressure in the air chamber, the second diaphragm functions to enlarge the volume of the pump chamber and enlargement of the volume of the pump chamber causes the fluid to flow into the pump chamber from the inflow port. Simultaneously, an air pressure in the accumulator 24 causes the liquid accumulated in the accumulator 24 to be flowed toward the outflow port.

Accordingly, the pump preferred as the third embodiment flows the fluid from the inflow port into the pump chamber like the pump preferred as the first or second embodiment, thereby flowing the fluid in a constant amount toward the outflow side even while the fluid does not flow from the pump chamber to the outflow port.

Though the leaf vales 13 and 14 are used as check valves in the pumps preferred as the first, second and third embodiments shown in FIGS. 5 through 8, these valves may not be leaf valves so far as the valves serve as check valves.

Unlike the pump preferred as the first or second embodiment which produces the pulsating flow by alternately producing a condition where the fluid is flowed toward the outflow side by the pump function and another condition where the fluid is not flowed, the pump preferred as the third embodiment reduces a pulsating flow by always flowing the fluid at a certain degree even while the pump function is not performed.

As understood from the foregoing description, the third embodiment reduces the pulsating flow and allows the fluid to be always flowed out without completely stopping supplying the fluid while the pump is operating to supply the fluid.

Accordingly, hot water is not splashed by a pulsating flow from a hot water supply port when the pump preferred as the third embodiment is used as a pump for supplying hot water from a pot or the like.

The accumulator used in the third embodiment is not limited to a member of silicone rubber or the like having a form such as that shown in FIG. 7 and may be made of another material which cannot be deformed and have a form different from that shown in FIG. 7. When the pump preferred as the third embodiment is used as liquid supply means of a hot water supply apparatus, for example, the accumulator may have an extremely small volume and may be a space (chamber) which is formed in the cover 18, for example, and connected to a flow path communicated with the outflow port.

In any case, the accumulator disposed in the third embodiment may have an form and be made of any material or disposed at any location so far as the accumulator has a space of an adequate size and is located higher than a flow path to which the accumulator is connected to that a fluid can easily move from the accumulator into the flow path.

The present invention makes it possible to obtain a pump which is not disabled from flowing out a liquid due to bubbles and has high durability of a diaphragm which is not broken by hot water at a high temperature.

What is claimed is:

1. A diaphragm pump comprising: a first diaphragm which is operated with a driving mechanism driven by a motor; a second diaphragm which is disposed so as to form an air chamber between said first diaphragm and said second diaphragm; a pump chamber which is formed on a side opposite to the air chamber of said second diaphragm; an inflow port and an outflow port which are connected to said pump chamber respectively; and check valves which are disposed between said pump chamber and said inflow port, and between said pump chamber and said outflow port respectively, wherein said first diaphragm is deformed by operating said driving mechanism by driving said motor, the second diaphragm is deformed by increase and decrease of a pressure in the air chamber which is caused by deformation of said first diaphragm, and a volume of the pump chamber is changed by deformation of said second diaphragm, thereby flowing a fluid from the inflow port into the pump chamber and flowing the fluid from the pump chamber into the outflow port to perform a pump function.

2. The diaphragm pump according to claim 1, wherein a plate like member is disposed so as to partition said air chamber into two, an orifice is formed in said plate like member, and a volume of a section of said air chamber which is formed between said first diaphragm and said plate like member is increased and decreased by deforming said first diaphragm, thereby deforming said second diaphragm by way of said orifice to perform the pump function.

3. The diaphragm pump according to claim 1 or 2, wherein an accumulator is disposed in a flow path connected to said outflow port.

4. The diaphragm pump according to claim 1 or 2, wherein said second diaphragm is composed of a deformable thin metal plate.

5. The diaphragm pump according to claim 1 or 2, wherein said second diaphragm is composed of a corrugated thin metal plate.

6. The diaphragm pump according to claim 4, wherein an accumulator is disposed in a flow path connected to said outflow port.

7. The diaphragm pump according to claim 5, wherein an accumulator is disposed in a flow path connected to said outflow port.

* * * * *